US011499391B2

(12) United States Patent
Jacob

(10) Patent No.: US 11,499,391 B2
(45) Date of Patent: Nov. 15, 2022

(54) DISSOLVABLE OBJECT WITH A CAVITY AND A FLUID ENTRY POINT

(71) Applicant: Gregoire Max Jacob, Houston, TX (US)

(72) Inventor: Gregoire Max Jacob, Houston, TX (US)

(73) Assignee: SOLGIX, INC, Houston, TX (US)

( * ) Notice: Subject to any disclaimer, the term of this patent is extended or adjusted under 35 U.S.C. 154(b) by 27 days.

(21) Appl. No.: 17/275,491

(22) PCT Filed: Oct. 25, 2019

(86) PCT No.: PCT/US2019/058076

§ 371 (c)(1),
(2) Date: Mar. 11, 2021

(87) PCT Pub. No.: WO2020/086968

PCT Pub. Date: Apr. 30, 2020

(65) Prior Publication Data

US 2022/0042393 A1 Feb. 10, 2022

Related U.S. Application Data

(60) Provisional application No. 62/751,044, filed on Oct. 26, 2018, provisional application No. 62/751,036,
(Continued)

(51) Int. Cl.
*E21B 19/24* (2006.01)
*E21B 23/01* (2006.01)
(Continued)

(52) U.S. Cl.
CPC ..... *E21B 33/134* (2013.01); *E21B 19/24* (2013.01); *E21B 23/01* (2013.01); *E21B 23/06* (2013.01);
(Continued)

(58) Field of Classification Search
CPC ..... E21B 19/24; E21B 2200/08; E21B 23/01; E21B 23/0413; E21B 23/06; E21B 29/00; E21B 33/124; E21B 33/128; E21B 33/1285; E21B 33/129; E21B 33/1293; E21B 33/134
See application file for complete search history.

(56) References Cited

U.S. PATENT DOCUMENTS 5,941,309 A 8/1999 Appleton
8,231,947 B2 7/2012 Vaidya
(Continued)

FOREIGN PATENT DOCUMENTS

WO PCT/CA2014/051083 5/2015
WO WO-2015069982 A2 * 5/2015 ..... E21B 33/12

*Primary Examiner* — Daniel P Stephenson
(74) *Attorney, Agent, or Firm* — Innovation and Patent IP Houston, LLC

(57) ABSTRACT

A dissolvable untethered object for use inside a well fluid includes an internal cavity and a fluid entry point. The internal cavity contains a gas. The fluid entry point is closed and selectively openable so that the internal cavity can be filled with the well fluid flowing through the fluid entry point. A dissolving rate of the dissolvable untethered object is modified after contact of the well fluid inside the internal cavity with the dissolvable untethered object.

20 Claims, 15 Drawing Sheets

Related U.S. Application Data filed on Oct. 26, 2018, provisional application No. 62/751,031, filed on Oct. 26, 2018.

(51) Int. Cl.

| | |
|---|---|
| ***E21B 23/06*** | (2006.01) |
| ***E21B 29/00*** | (2006.01) |
| ***E21B 33/124*** | (2006.01) |
| ***E21B 33/128*** | (2006.01) |
| ***E21B 33/129*** | (2006.01) |
| ***E21B 33/134*** | (2006.01) |

(52) U.S. Cl.

CPC ..... *E21B 29/00* (2013.01); *E21B 33/124* (2013.01); *E21B 33/128* (2013.01); *E21B 33/129* (2013.01); *E21B 33/1285* (2013.01); *E21B 33/1293* (2013.01); *E21B 2200/08* (2020.05)

(56) References Cited

U.S. PATENT DOCUMENTS

| | | | | |
|---|---|---|---|---|
| 8,714,268 | B2 | 5/2014 | Agrawal et al. | |
| 9,316,090 | B2 | 4/2016 | Walton et al. | |
| 2010/0270031 | A1 | 10/2010 | Patel | |
| 2011/0132619 | A1* | 6/2011 | Agrawal | E21B 23/04 166/376 |
| 2011/0132620 | A1 | 6/2011 | Agrawal et al. | |
| 2013/0032357 | A1* | 2/2013 | Mazyar | E21B 29/00 166/376 |
| 2015/0159462 | A1 | 6/2015 | Cutler | |
| 2016/0130906 | A1 | 5/2016 | Garvey | |
| 2016/0251935 | A1 | 9/2016 | Jacob et al. | |
| 2016/0356137 | A1* | 12/2016 | Hardesty | E21B 43/26 |
| 2022/0042393 | A1* | 2/2022 | Jacob | E21B 33/1293 |

* cited by examiner

DISSOLVABLE OBJECT WITH A CAVITY AND A FLUID ENTRY POINT

BACKGROUND

This disclosure relates generally to methods and apparatus for modifying a dissolving rate of an untethered object used inside a well fluid. This disclosure relates more particularly to modifying the dissolving rate of an untethered object by selectively contacting the well fluid with an internal cavity of the untethered object.

The first five figures (FIGS. 1 to 5) refer to one environment example in which the methods and apparatus for providing a plug inside a tubing string containing well fluid described herein may be implemented and used.

FIG. 1 illustrates a typical cross section of an underground section dedicated to a cased-hole operation. The type of operation is often designated as Multi-Stage-Stimulation, as similar operations are repeatedly performed inside a tubing string in order to stimulate the wellbore area.

The wellbore may have a cased section, represented with tubing string 1. The tubing string contains typically several sections from the surface 3 until the well end. The tubing string represented schematically includes a vertical and horizontal section. The entire tubing string contains a well fluid 2, which can be pumped from surface, such as water, gel, brine, acid, and also coming from downhole formation such as produced fluids, like water and hydrocarbons.

The tubing string 1 can be partially or fully cemented, referred as cemented stimulation, or partially or fully free within the borehole, referred as open-hole stimulation. Typically, an open-stimulation will include temporary or permanent section isolation between the formation and the inside of the tubing string.

The bottom section of FIG. 1 illustrates several stimulation stages starting from well end. In this particular well embodiment, at least stages 4*a*, 4*b*, 4*c* have been stimulated and isolated from each other. The stimulation is represented with fluid penetration inside the formation through fracturing channels 7, which are initiated from a fluid entry point inside the tubing string. This fluid entry point can typically come from perforations or sliding sleeves openings.

Each isolation includes a set plug 6 with its untethered object 5, represented as a spherical ball as one example.

The stimulation and isolation are typically sequential from the well end. At the end of stage 4*c*, after its stimulation 7, another isolation and stimulation may be performed in the tubing string 1.

FIG. 2 depicts a sequential step of FIG. 1 with the preparation of subsequent stage 4*d*. In this representation, a toolstring 10 is conveyed via a cable or wireline 9, which is controlled by a surface unit 8. Other conveyance methods may include tubing conveyed toolstring, coiled tubing. Along with a cable, a combination of gravity, tractoring and pump-down may be used to bring the toolstring 10 to the desired position inside the tubing string 1. In FIG. 2, the toolstring 10 conveys an unset plug 11, dedicated to isolating stage 4*c* from stage 4*d*.

FIG. 3 depicts a sequential view of FIG. 2, where the unset plug has been set (6) inside the tubing string 1, and further perforating has been performed uphole of the set plug 6. Typically, the set plug creates a restriction in the tubing string able to receive after an untethered object such as a ball. The toolstring 10 and cable 9 of FIG. 2 have then been removed from the tubing string.

FIG. 4 depicts a sequential view of FIG. 3, where an untethered object 5 is pumped from surface 3 with the well fluid 2 inside the tubing string 1.

FIG. 5 depicts a sequential view of FIG. 4, where the untethered object 5 lands on the set plug 6 and creates a well fluid isolation uphole compared to downhole of the plug position. Further pumping may increase the fluid pressure uphole of the plug position 6, including on the untethered object 5, of the stage 4*d*. Additional pumping rate and pressure may create a fluid stimulation 7 inside the formation located on or near stage 4*d*. When the stimulation is completed, another plug may be set and the overall sequence of stages 1 to 5 may start again. Typically, the number of stages may be between 10 and 100, depending on the technique used, the length of well and spacing of each stage.

There is a continuing need in the art for methods and apparatus for modifying a dissolving rate of an untethered object used inside a well fluid, preferably by selectively contacting the well fluid with an internal cavity of the untethered object.

BRIEF DESCRIPTION OF THE DRAWINGS

For a more detailed description of the embodiments of the disclosure, reference will now be made to the accompanying drawings.

DETAILED DESCRIPTION

It is to be understood that the following disclosure describes several exemplary embodiments for implementing different features, structures, or functions of the invention. Exemplary embodiments of components, arrangements, and configurations are described below to simplify the disclosure; however, these exemplary embodiments are provided merely as examples and are not intended to limit the scope of the invention.

Figure 1:
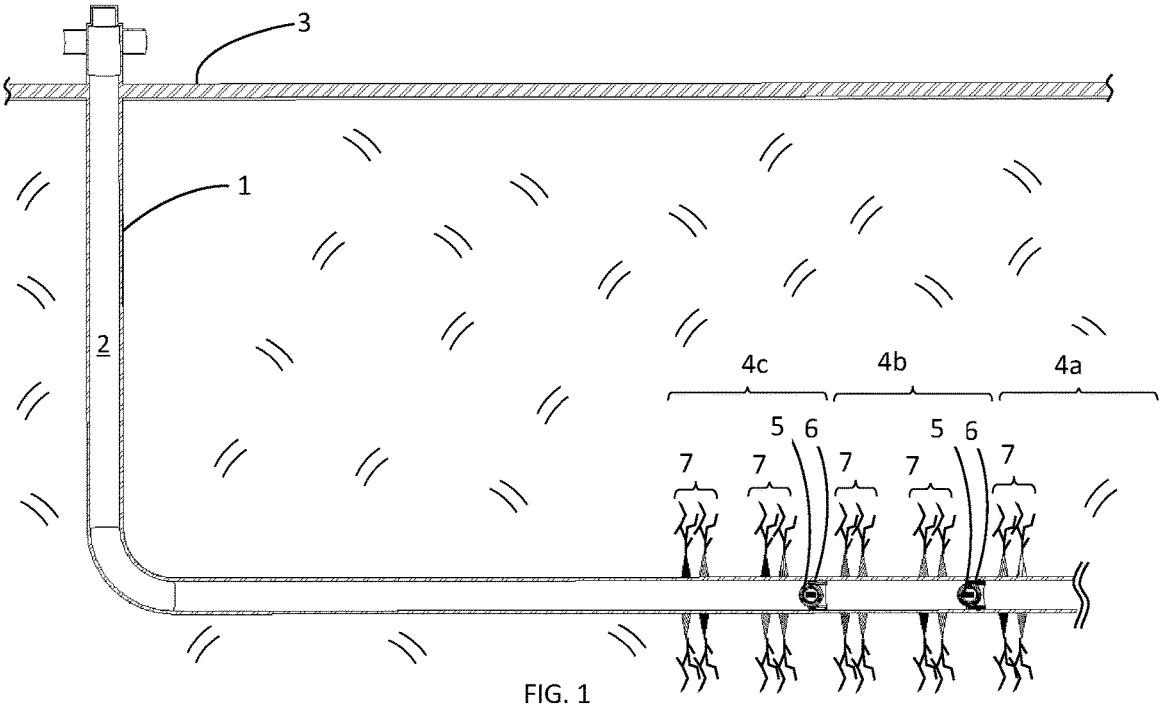
FIG. 1 is a wellbore cross-section view of typical Multi-Stage-Stimulation operation ongoing, with three stages completed.
Figure 2:
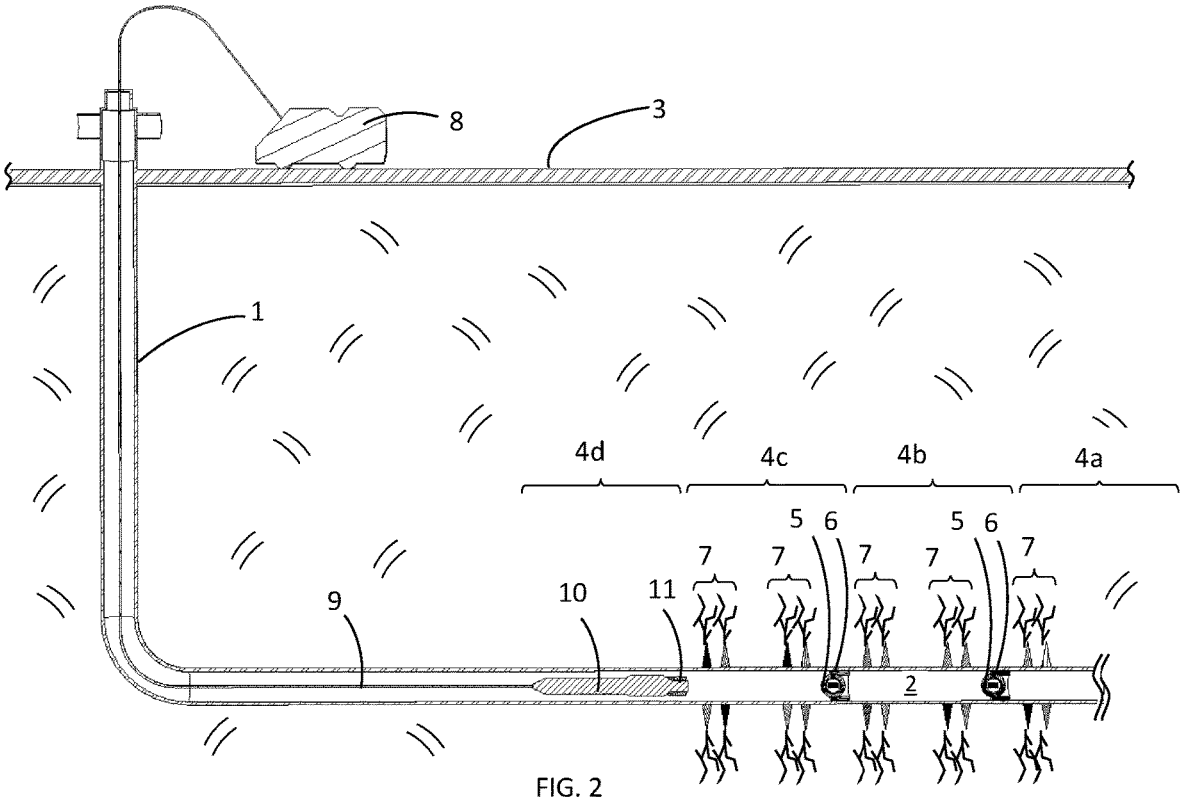
FIG. 2 is a wellbore cross-section view of toolstring conveyance to install the third isolation device for the fourth stage.
Figure 3:
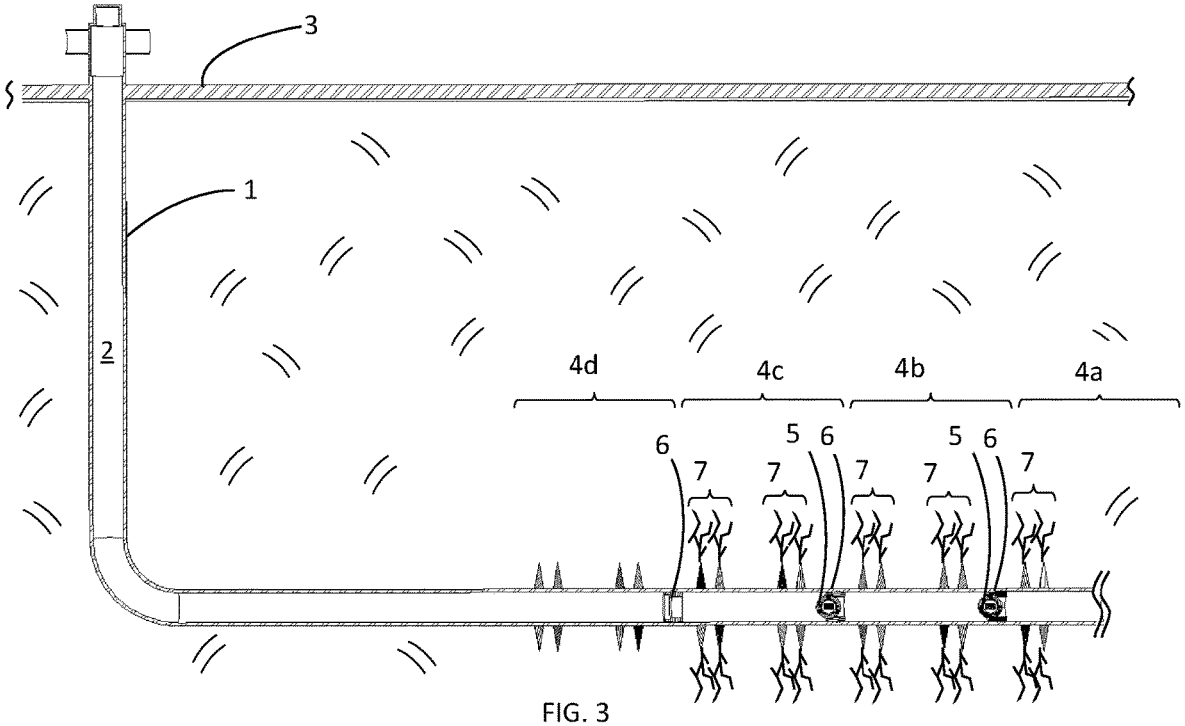
FIG. 3 is a wellbore cross-section view of the third stage isolation device being set and the fourth stage being perforated.
Figure 4:
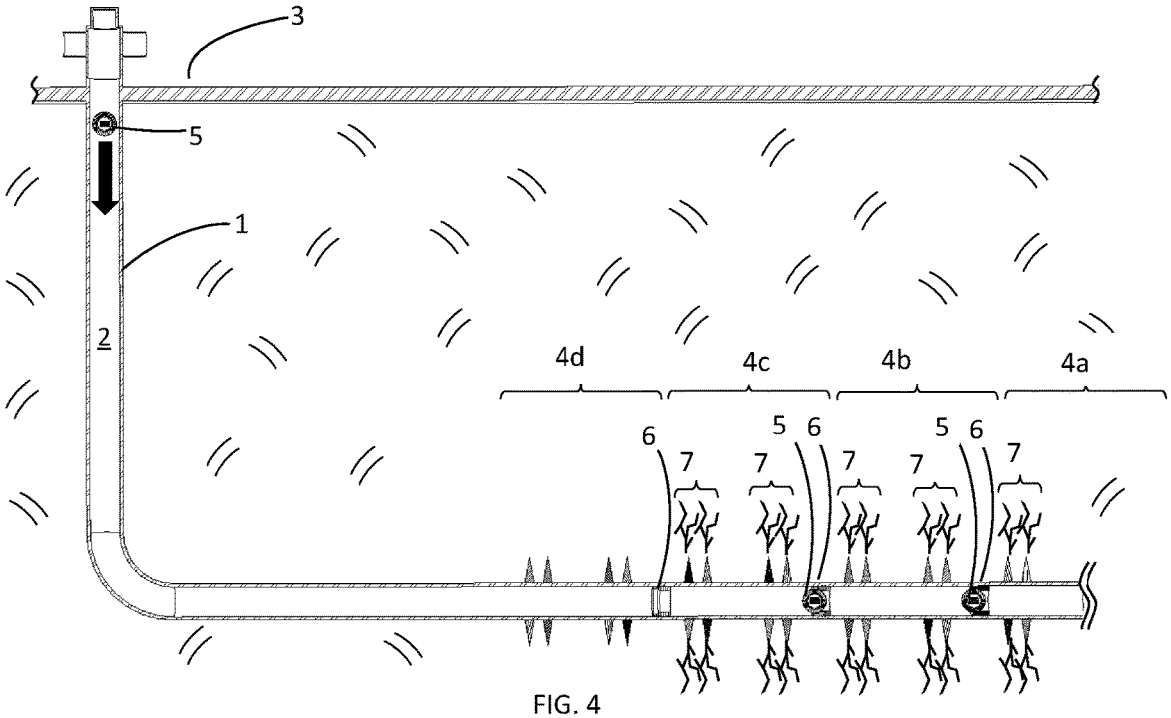
FIG. 4 is a wellbore cross-section view of an untethered object being dropped inside the well and moving towards the third isolation device through the perforated area.
Figure 5:
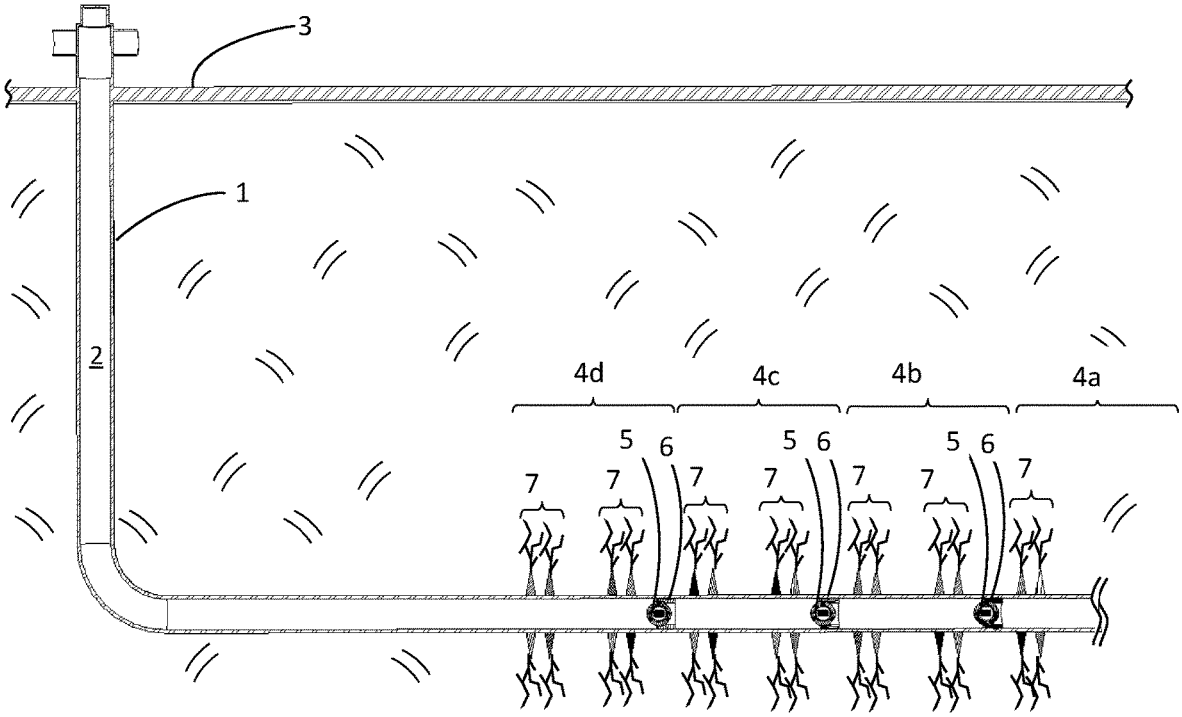
FIG. 5 is a wellbore cross-section view of the fourth stage isolated from the third stage by a plug and untethered object, and completed with pressure pumping operation.
Figure 6A:
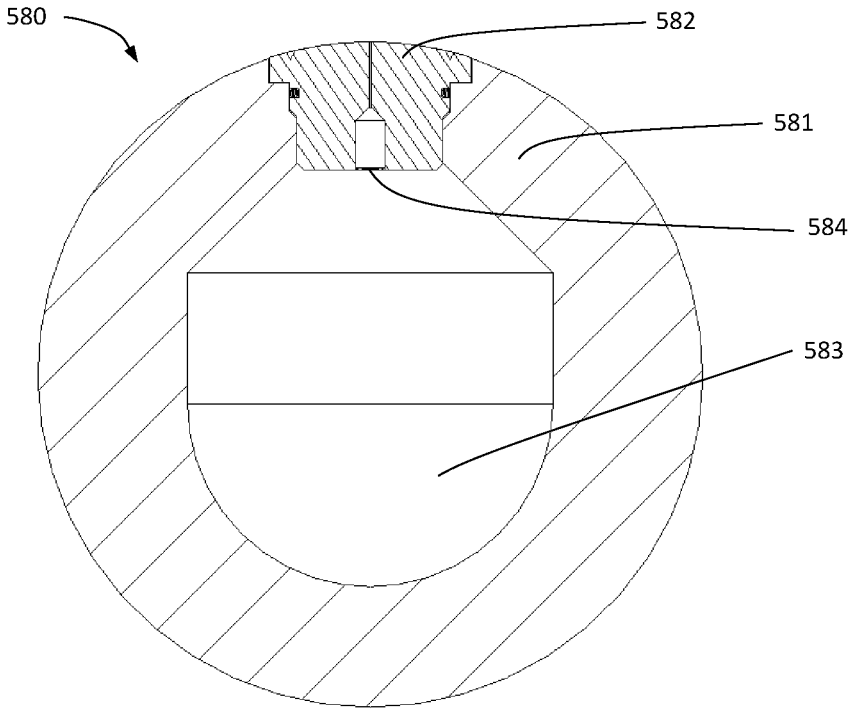
FIG. 6A is a cross section view of a dissolvable untethered object, with a cavity and pressure entry point.

FIG. 6A represents an aspect of the disclosure. FIG. 6A depicts a cross section of a dissolvable untethered object 580. The dissolvable untethered object may be used as item 5 in FIGS. 1-5 previously described, as a plugging element, although the dissolvable untethered object 580 could also be used as an untethered object for other functions inside a cased hole or open hole. Examples of usage could include balls for sliding sleeves, balls for perforation obstruction, balls for plunger elements, as well as pumped down intervention tools which may require to dissolve within a specific or wished timeframe within the well fluid.

Example advantages of the dissolvable untethered object 580 could be to better control the rate of dissolving of the dissolvable untethered object, by including a cavity, therefore reducing the overall material volume of the untethered object and selectively increasing the total surface contact area of the dissolvable untethered object with well fluid by adding an inner surface. Furthermore, the internal cavity and connection points with set plug 6 may not alter the external surface continuity of the dissolvable untethered object, as many functions rely on adequate surface contact between an untethered object and a feature already present inside the wellbore. In addition, the embodiment may not require liquid filling of the untethered object at surface before launching inside the wellbore.

The dissolvable untethered object 580 is represented mainly as a sphere, though other shapes such as dart, pill, barrel, polyhedron are possible.

In this representation, the dissolvable untethered object includes a main section 581, which includes a cavity 583, and is adapted to fit a plugging element 582. The plugging element includes a thin section 584. To be noted, reasons for the untethered object 580 including both a main section 581 and a plugging element 582, can be practicality of manufacturing. The sufficient two features may be the cavity 583 and a thin section 584. In order to realize practically those two features (583, 584), the plugging element appears as one possible embodiment.

The material used for the main section 581 and for the plugging element 582 may be preferably out of dissolvable material, like a dissolvable metal or alloy, as well as dissolvable polymers. A dissolvable material would have the capacity to degrade in small particles inside the well fluid in periods from a few hours to a few months. The material used for the main section 581 and plugging element 582 may be different, for example with different dissolving rates or different structural properties. Possibly the plugging element 582 may not be built out of dissolvable material, only letting the main section 582 dissolving.

The cavity 583 will be preferably filled with ambient air or any gas, such as inert gas, which is not reacting with the dissolving material used for the main section 581 and possibly the plugging element 582. As such, the cavity 583 is kept stable with non-reacting gas, as long as the untethered object 580 is under manufacturing stage, storing stage, or at surface and not inside well fluid. The thin section 584 may prevent any communication of gas or fluid towards the cavity 583 while the untethered object is not placed inside a wellbore fluid and has not reached a predetermined pressure.

The thin section 584 is adapted to rupture or shear at fluid pressure preferably ranging from 1 psi to 30,000 psi. The rupture of thin section 584 may therefore occur while inside the well fluid of the wellbore. The rupture pressure would either be reached by hydrostatic pressure, preferably after reaching an equivalent depth underground inside the wellbore, or be reached by pressurizing the well fluid through an external mean, preferably with a pump connected to the wellbore. The thin section 584 may have different thickness, surface area, materials and coatings in order to adjust and ensure the rupture pressure rating. The thin section 584 may be built out of another material than the plugging element 582, which may not be dissolvable. Therefore, the thin section 584 may be installed inside the plugging element 582 as an external component, the attachment may include threading, press-fitting, welding, gluing. Alternatively, it may be built out of the same material as the plugging element 582.

An additional coating, not represented, around the dissolvable untethered object 580, could be added. A coating, such as polyurethane, anodization, Teflon base, could protect the outside surface of the dissolvable untethered object 580, while not impairing the fluid entry at the rupture of the thin section 584. A coating with thickness between 0.02 mm to 1 mm [0.001 in to 0.04 in] may linearize possible surface discontinuity between, for example, the main section 581 and the plugging element 582, and therefore create a more uniform outside surface, in case the dissolvable untethered object is used to match the circumferential shapes of an object present inside the wellbore. Such object could be a plug opening, a seat opening, an orifice in a tubing or in a sleeve.

Figure 6B:
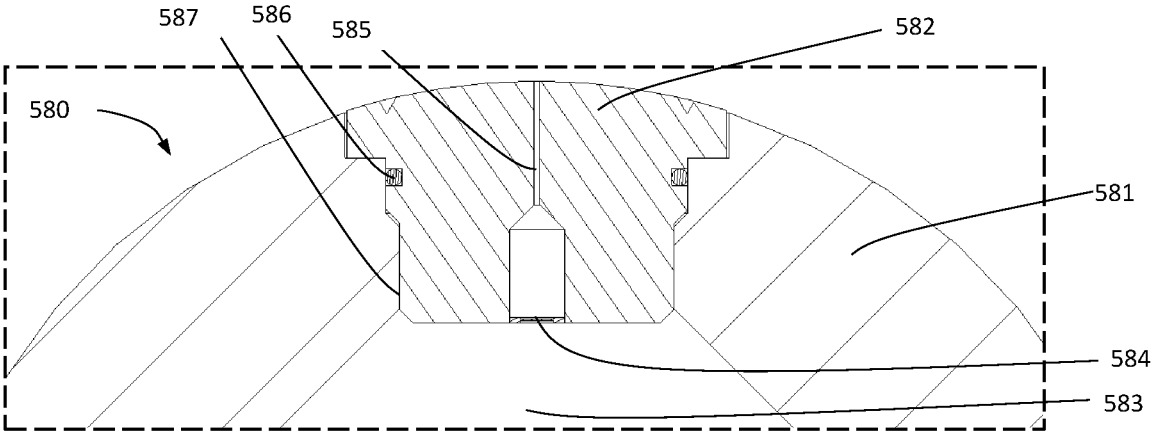
FIG. 6B is a detailed view of the cross section of FIG. 6A, showing a pressure entry point, according to an example embodiment.

FIG. 6B represents a close-up view of the cross-section depicted in FIG. 6A. Optional features of the plugging element 582 are represented. The plugging element 582 may include an attachment surface 587 as a press-fit or a threaded connection, in order to secure the plugging element 582 on the main section 581. In addition, a sealing element 586 may be added to limit fluid passing on the circumference of the plugging element 582 towards the cavity 583. A capillary hole 585 may be included inside the plugging element 582 in order to connect the well fluid of the wellbore to the thin section 584. Preferably, the capillary hole 585 may be small in diameter, such as 0.1 mm to 5 mm [0.004 in to 0.2 in] to allow fluid entry while limiting the discontinuity of the external surface of the untethered object 580.

Figure 6C:
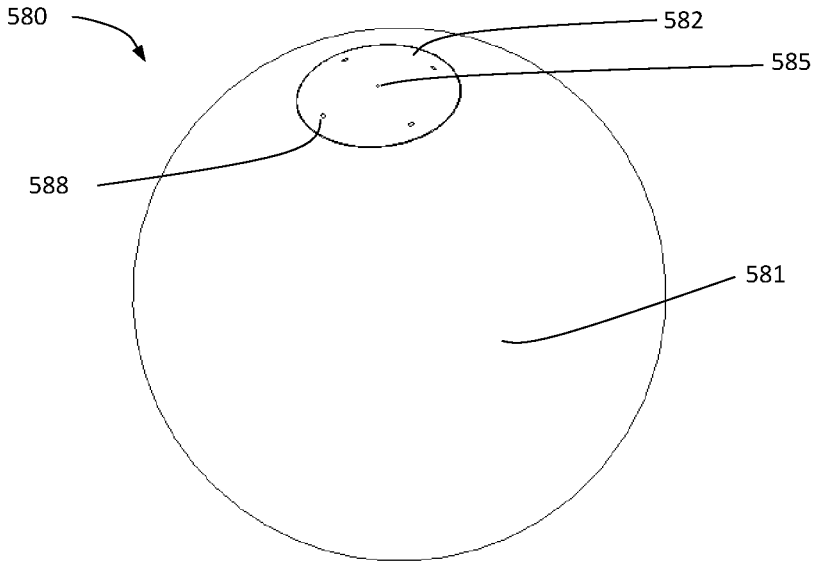
FIG. 6C is an isometric view of FIG. 6A.

FIG. 6C represents an isometric view of the same embodiment as FIG. 6A. The figure depicts in particular the main section 581 and the plugging element 582 of the dissolvable untethered object 580. Also represented are the visible outside section of the capillary hole 585. Additional holding holes 588 may be added inside the plugging element 582 in order to provide a gripping pattern for a special wrench in case the plugging element 582 is threaded together with the main section 581.

Figure 7A:
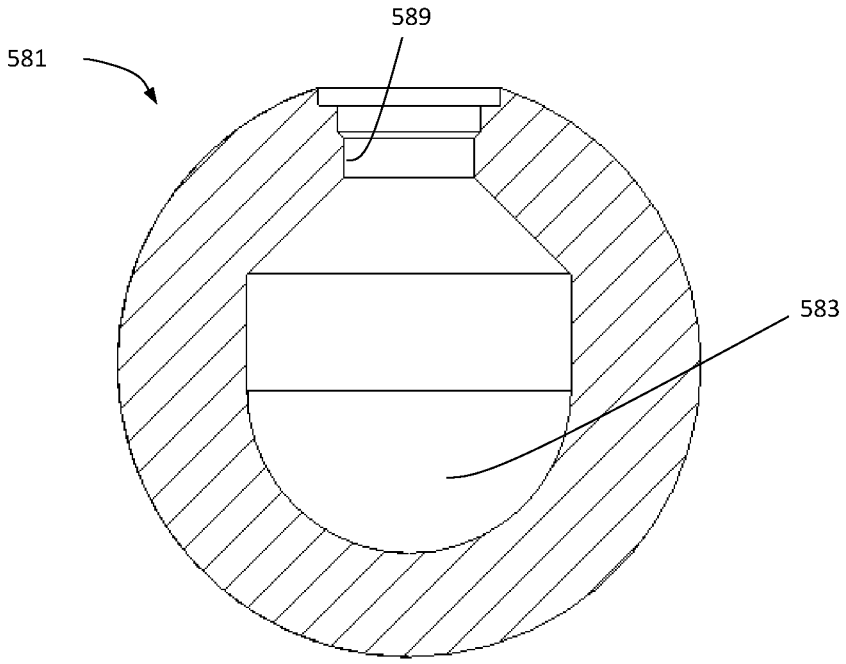
FIG. 7A is a cross sectional view of a dissolvable untethered object, with a cavity and pressure entry point, without showing the plug containing a pressure entry point.

FIG. 7A represents a cross sectional view of the main section 581. The figure depicts the cavity 583 and a connection surface 589, which correspond to the attachment with connection surface 587 of the plugging element 582, as represented in FIG. 6B.

Figure 8A:
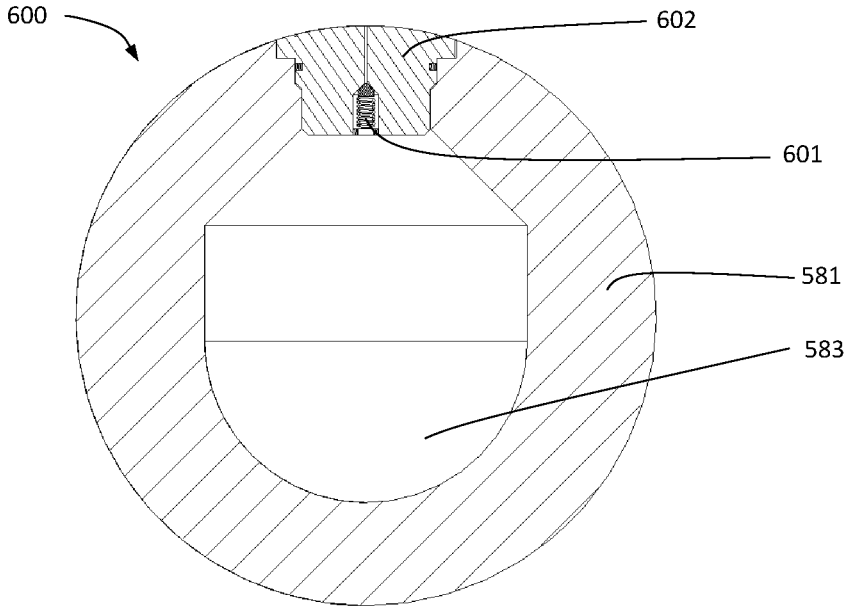
FIG. 8A is a cross sectional view of a dissolvable untethered object, with a cavity and pressure entry point as a pressure relief valve.

FIG. 8A represents another embodiment with a dissolvable untethered object 600. A represented difference compared to the embodiment of FIG. 6A is the replacement of the thin section 584 of FIG. 6A with a pressure relief valve 601. The pressure relief valve 601 may be included inside a plugging element 602. Other components of the embodiment, such as the main section 581 and cavity 583 may be similar to the ones described in FIG. 6A. The pressure relief valve 601 may operate as a fluid opening for a relief pressure higher than the one set by the pressure relief valve. Preferably, the pressure relief valve 601 may open and allow fluid communication with a relief pressure above 1 psi to 30,000 psi. When placed inside well fluid, the pressure relief valve 601 may open above the relief pressure and allow the cavity 583 to fill-up with well fluid.

Figure 8B:
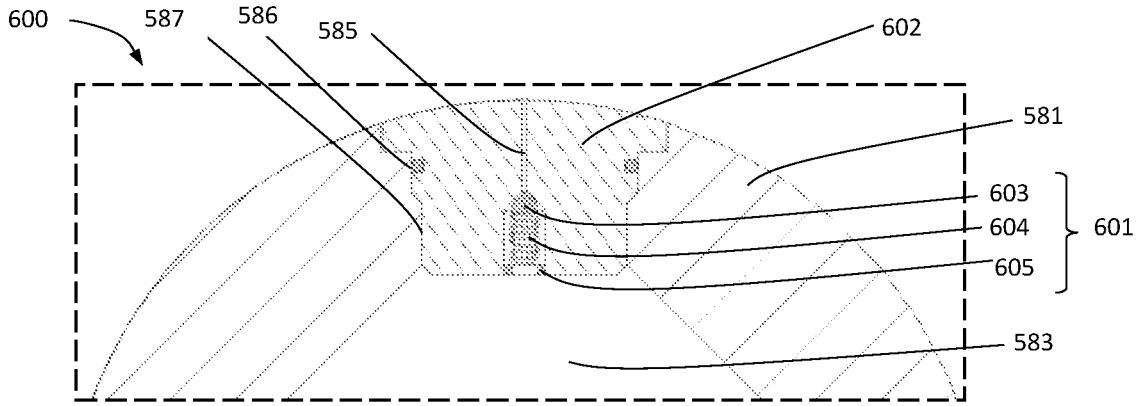
FIG. 8B is a detailed view of the cross section of FIG. 8A, showing a plug containing a pressure relief valve, according to an example embodiment.

FIG. 8B represents a close-up view of the cross-section depicted in FIG. 8A. Similarly to the embodiment described in FIG. 6A, the plugging element 602 may include an attachment surface 587, a sealing element 586, and a capillarity orifice 585. The pressure relief valve 601 may include a plunger 603, a spring 604 and spring retainer 605. Preferably, the relief pressure adjustment is made by adjusting the spring 604 retaining force and the surface of the plunger 603 exposed to fluid. Preferably, the pressure relief valve 601 may be built out of a combination of dissolving and non-dissolving material.

Figure 9:
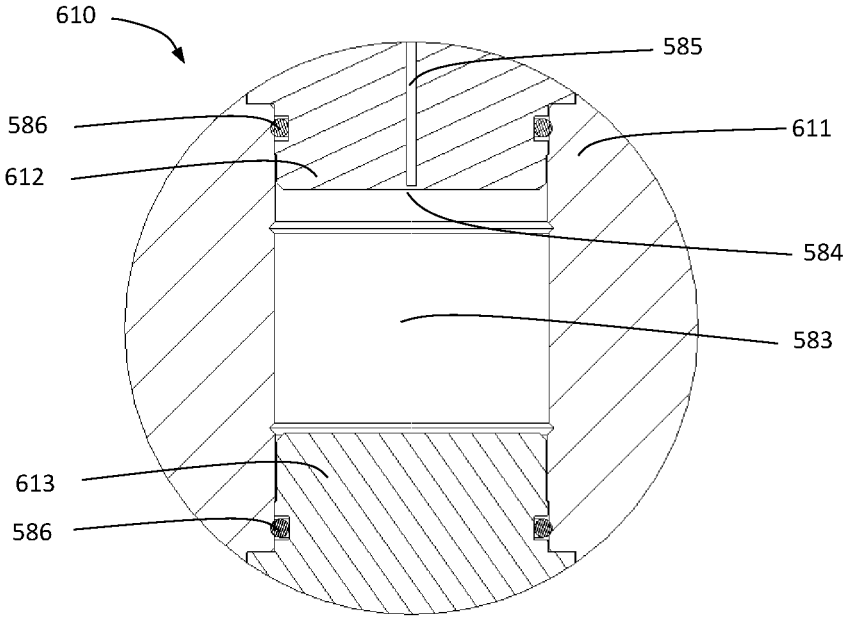
FIG. 9 is a cross sectional view of another embodiment of a dissolvable untethered object, with a cavity inside a main section and two plugs, one containing a pressure entry point.

FIG. 9 represents a cross-section of another embodiment of a dissolvable untethered object 610. The functions of the dissolvable untethered object 610 may be similar to the ones described in the embodiment of FIG. 6A. In the embodiment of FIG. 9, the main section 611 may include a cavity 583, which may be mainly cylindrical. The manufacturing of the main section 611 may be simplified over the main section 581 depicted in FIG. 6A.

Two plugging elements may be present, a first one, indicated as 612, including a thin section 584 and capillarity orifice 585, and second one, indicated as 613, being a plain element. Both plugging elements 612 and 613 may include a sealing element 586 to reduce fluid leakage between the plugging elements (612, 613) and the main section 611.

Figure 10:
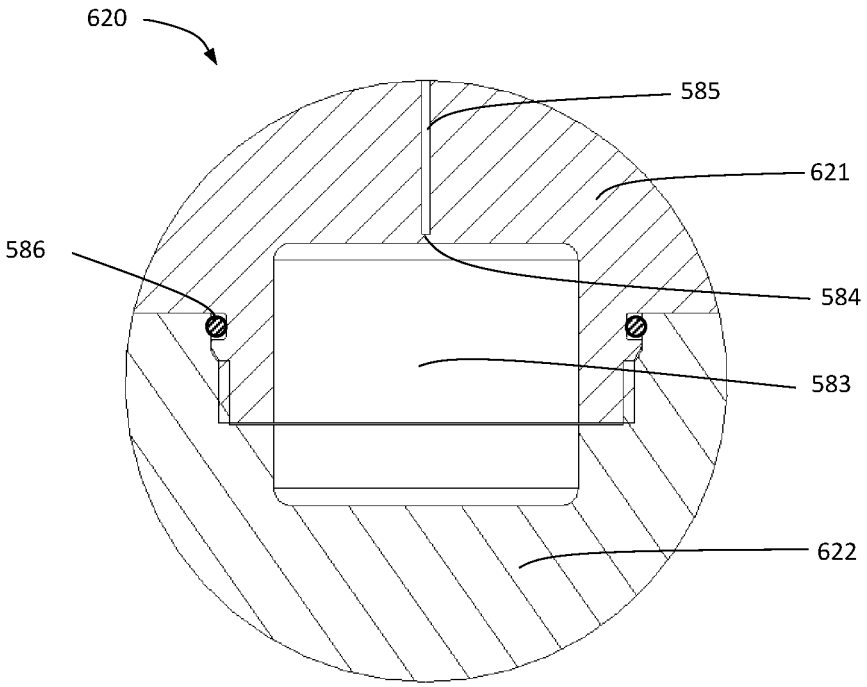
FIG. 10 is a cross sectional view of another embodiment of a dissolvable untethered object, with a cavity and main sections, one containing a pressure entry point.

FIG. 10 represents a cross-section of another embodiment of a dissolvable untethered object 620. The functions of the dissolvable untethered object 620 may be similar to the ones described in the embodiment of FIG. 6A. In the embodiment of FIG. 10, the dissolvable untethered object 620 may include two main sections, a first main section 621 and a second main section 622. The cavity 583 may be created between the two main sections, first section 621 and second section 622. The manufacturing of the embodiment 620 may be simplified or different compared to the embodiment 580 of FIG. 6A or the embodiment 610 of FIG. 9. The thin section 584 as well as the capillarity orifice 585 may be included in the first main section 621. A sealing element 586 may be included to reduce fluid leakage between the two main sections 621 and 622, when assembled together.

Figure 11:
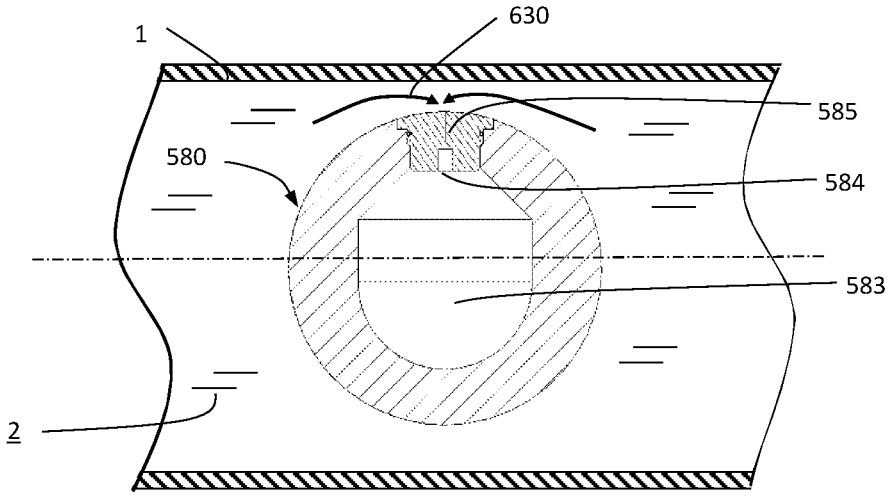
FIG. 11 is a cross-sectional view of a dissolvable untethered object placed inside the well fluid of a tubing string.

FIG. 11 represents a cross-sectional view of a dissolvable untethered object 580 placed inside the well fluid 2 of a tubing string 1. Note that a tubing string 1 is not necessary for the function of this dissolvable untethered object 580 and an open-hole wellbore may be suited as well. FIG. 11 represents the dissolvable untethered object 580 as a function example. Previously described embodiment, such as 600 of FIG. 8A, 610 of FIG. 9 or 620 of FIG. 10, may function similarly.

In FIG. 11, the dissolvable untethered object 580 is placed inside the well fluid 2. As the well fluid pressure exceed the rupture pressure of the thin section 584, a fluid entry 630 may be possible through the capillarity orifice 585 inside the cavity 583. Before the fluid entry 630 occurs, the cavity 583 may be filled with air or an inert gas. Therefore, up to the fluid entry 630 event, no significant dissolving of the dissolvable material contacting the cavity 583 was happening.

Figure 12:
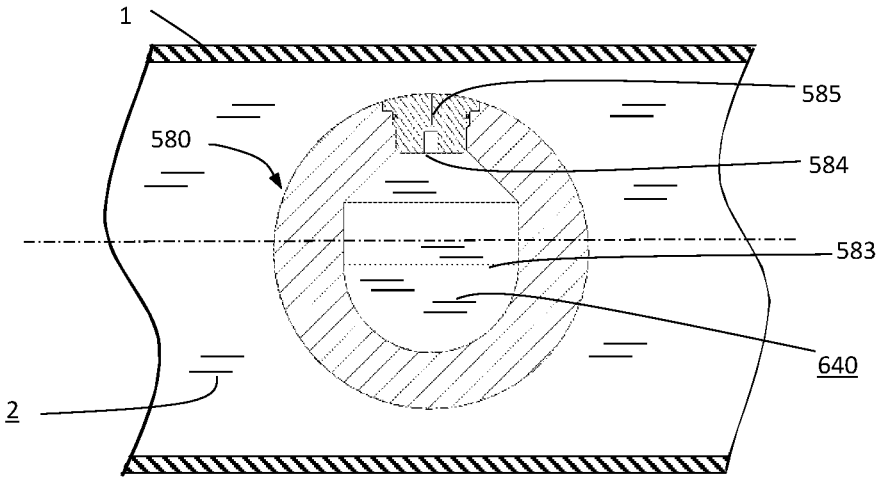
FIG. 12 is a cross-sectional view of a dissolvable untethered object placed inside the well fluid of a tubing string, with well fluid entering inside the cavity of the dissolvable untethered object through a pressure entry point.

FIG. 12 represents a cross-sectional view of a dissolvable untethered object 580 placed inside the well fluid 2 of a tubing string 1, and is sequential of FIG. 11. In FIG. 12, penetrated well fluid 640 has replaced the air or gas previously present inside the cavity 583. The air or gas may then be dissipated inside the rest of the well fluid 2 present inside the tubing string 1. With penetrated well fluid 640 present inside the cavity 583 of the dissolvable untethered object 580, the dissolving behavior may be modified, and in particular be accelerated, as now more surface area of the dissolvable untethered object is in contact with well fluid.

Figure 13:
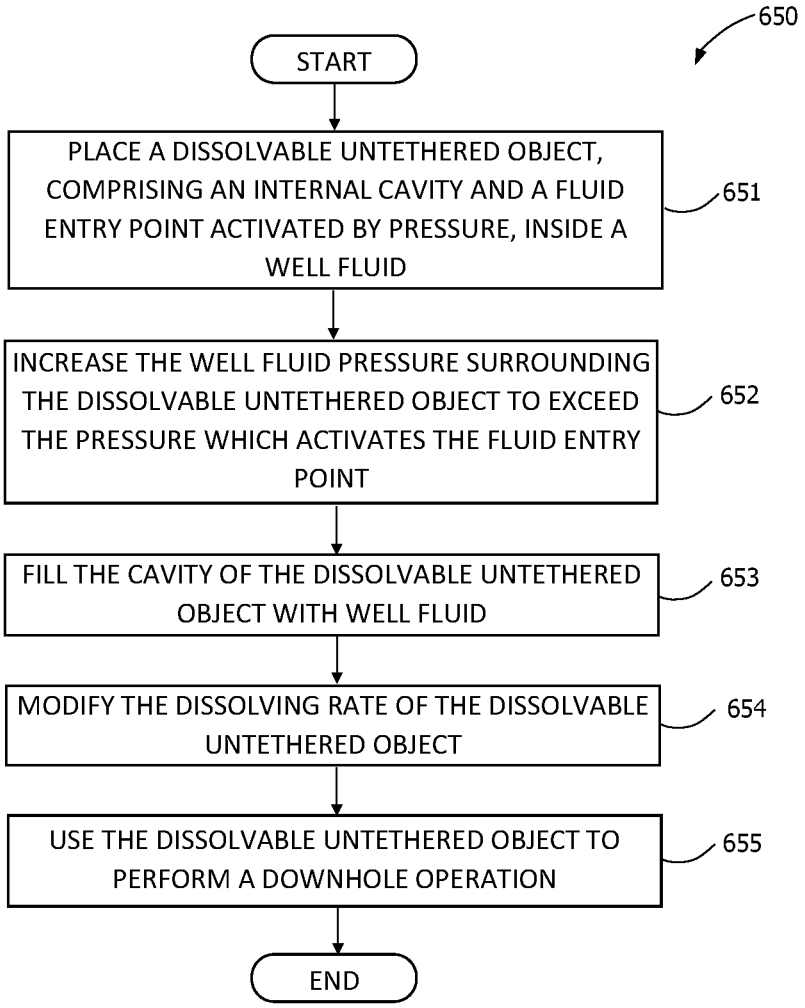
FIG. 13 is a flow diagram representing a technique sequence of placing a dissolvable untethered object inside well fluid, and having well fluid entering inside the cavity of the dissolvable untethered object through a pressure entry point, to accelerate the dissolving rate of the untethered object.

FIG. 13 represents a technique sequence 650, which includes steps depicted in FIGS. 11 and 12.

Step 651 corresponds to the placement of a dissolvable untethered object 580 comprising an internal cavity 583 and a fluid entry point 584 activated by pressure, inside a well fluid 2. Then in step 652, the well fluid pressure surrounding the dissolvable untethered object 580 exceeds the pressure which activates the fluid entry point 584. In step 653, the well fluid enters and fills the cavity 583 of the dissolvable untethered object. In step 654, the dissolving rate of the dissolvable untethered object 580 is modified by the contact of the well fluid along the surface of the cavity 583 Finally step 655 corresponds to the further usage of the dissolving untethered object to perform a downhole operation.

Figure 14:
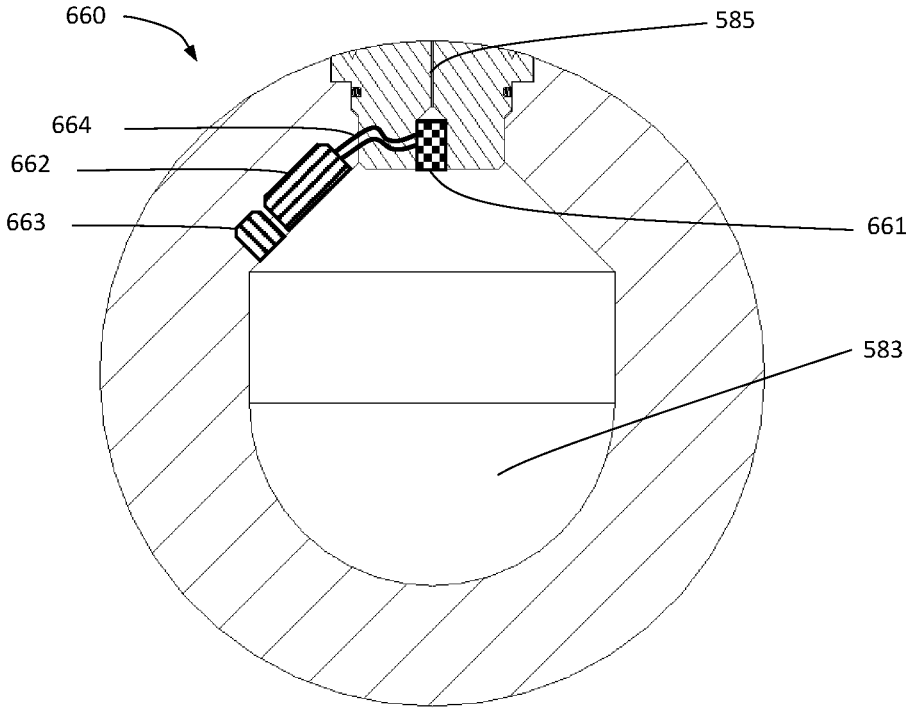
FIG. 14 is a cross-sectional view of another dissolvable untethered object with a cavity, having an electrically actuated fluid entry point with a programmable starter.

FIG. 14 represents another embodiment of a dissolvable untethered object 660. In FIG. 14, the dissolvable untethered object includes an electrically actuated entry point 661. The electrically actuated entry point 661 may include a disintegrating section which may consume itself after being activated with a current.

The electrically actuated entry point 661 may represent a pressure barrier for the well fluid, preventing the fluid from entering the internal cavity 583 inside the dissolvable untethered object 660 through a capillarity orifice 585. The fluid barrier may let pass well fluid inside the internal cavity 583, after the fluid barrier has been activated by a programmable starter 662, connected to the electrically actuated entry point through wires 664.

The programmable starter 662 may be programmed at surface, prior to place the untethered object 660 inside the well fluid. The programming of the programmable starter 662 may include pre-setting a time, such as 1 minute to 1 month, pre-setting a temperature, such as 20 degC. to 250 degC. [68 degF. to 482 degF.], pre-setting a pressure, such as 1 psi to 30,000 psi [0.007 MPa to 200 MPa] or combination thereof. The programmable started 662 may therefore include a sensor able to read the temperature, pressure or other fluid properties such as the salinity, the pH, of the fluid surrounding the dissolvable untethered object 660. The combination of programming may include a minimum fluid temperature or a minimum fluid pressure, after reaching a minimum time, in order to activate the electrically actuated entry point 661, and therefore start the filling up of the internal cavity 583 by well fluid, which may modify the dissolving rate of the dissolvable untethered object 660.

A battery 663, connected to the programmable starter 662 may be necessary to power the electronic as well as provide current to activate the electrically actuated entry point 661.

Figure 15:
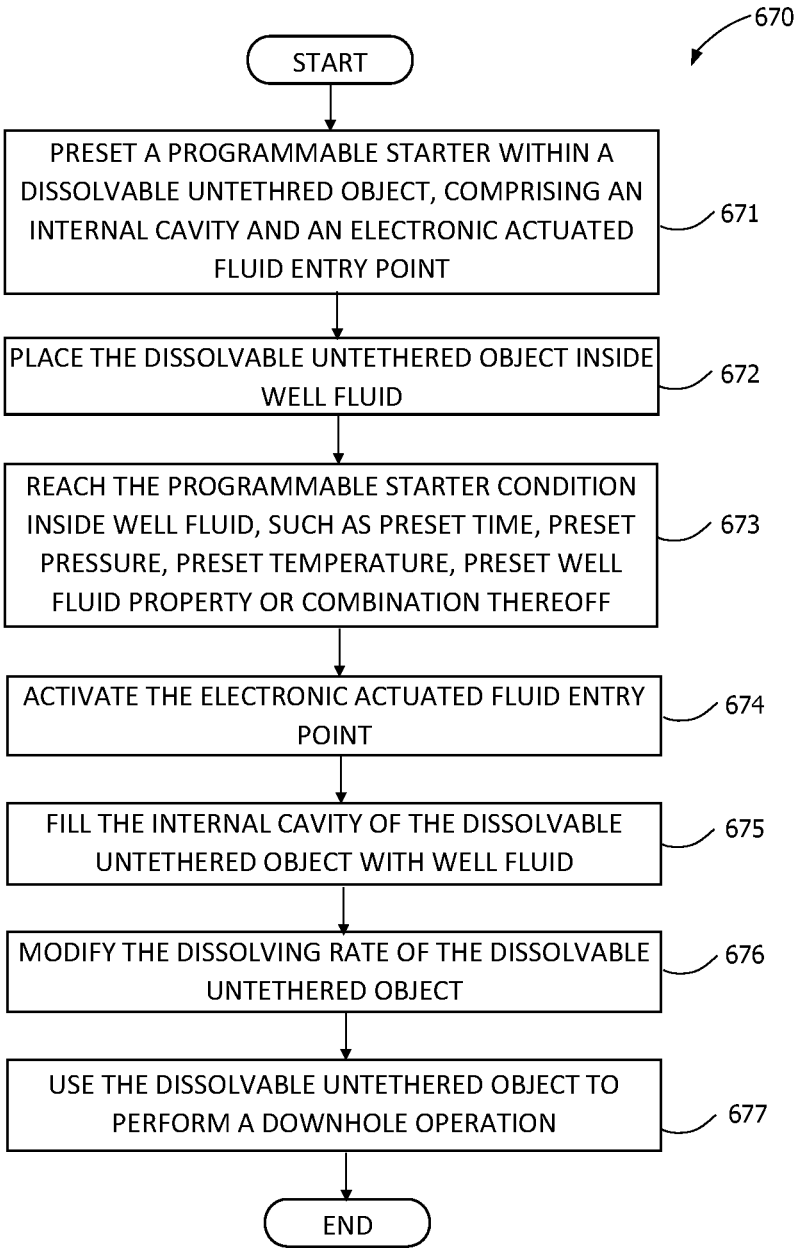
FIG. 15 is a flow diagram representing a technique sequence of placing a dissolvable untethered object inside well fluid, and having well fluid entering inside the cavity of the dissolvable untethered object through an electrically actuated entry point with a programmable starter, to accelerate the dissolving rate of the untethered object.

FIG. 15 represents a technique sequence 670, related to the usage of the dissolvable untethered object 660 of FIG. 14. In Step 671, a programmable starter 662 within a dissolvable untethered object 660 is preset with desired actuation conditions, such as preset time, preset pressure, preset temperature, preset well fluid property like pH or salinity, or combination thereof. Step 672 corresponds to the placement of the dissolvable untethered object 580 comprising a gas-filled internal cavity 583 and an electronic actuated fluid entry point 661, inside well fluid. Then in step 673, the desired actuation conditions are reached. In step 674, the electronic actuated fluid entry point is activated by the programmable starter 662. In step 675, the well fluid enters and fills the cavity 583 through the electronic actuated fluid entry point 661. In step 676, the dissolving rate of the dissolvable untethered object 660 is modified by the contact of the well fluid along the surface of the cavity 583. Finally step 677 corresponds to the further usage of the dissolvable untethered object 660 to perform a downhole operation.

Figure 16A:
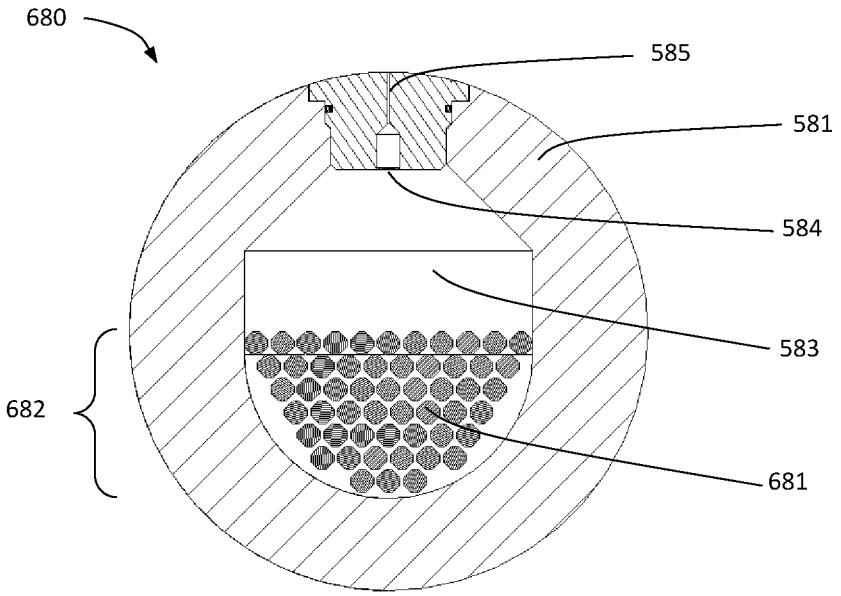
FIG. 16A is a cross-sectional view of another dissolvable untethered object with a cavity including a catalyst or inhibitor to modify the dissolving rate of the untethered object.

FIG. 16A represents another embodiment. FIG. 16A represents a cross-section of a dissolvable untethered object 680. The dissolvable unthread object 680 includes a main section 581, a cavity 583, a thin section 584 and capillarity orifice 585, whereby those elements can be similar to the ones described in FIG. 6A.

The cavity 583 is represented with the possibility to contain a material capable of mixing with the well fluid, such as catalyst 681. The remaining of the volume of the cavity 583 which is not containing the catalyst 681 is preferably a gas, such as air or an inert gas, which has no significant interaction with the dissolvable material of the dissolvable untethered object 680, nor with the catalyst 681, during a preferred shell life of the embodiment, from one week to ten years.

The material capable of mixing with the well fluid, such as the catalyst 681, may be a chemical compound, which, when mixed with well fluid, would modify the dissolving rate of the material of the dissolvable untethered object 680. The modification of the dissolving rate would primarily affect the material in direct contact with the mix well fluid and catalyst 681, which would be the inner surface of the cavity 583 in this representation.

The mix of well fluid and catalyst would accelerate the dissolution reaction of the dissolvable untethered object 680. Alternatively, when the internal cavity is originally filled with a corrosive gas, and the material capable of mixing with the well fluid is an inhibitor instead of a catalyst, the mix of well fluid and inhibitor would decelerate the dissolution reaction of the dissolvable untethered object 680.

For this purpose, the material capable of mixing with the well fluid, such as catalyst 681, may have a solid form, such as powder, pellet, block which would fit geometrically in a portion of the volume of the cavity 583. The catalyst may also have a liquid form if encapsulated in shells preventing its reaction with the air or gas present in the cavity 583 and with the material of the dissolvable untethered object 583. The shell encapsulation may include a dissolvable plastic, such as a PLA, Polylactic Acid, which would react with the well fluid and in turn free the liquid catalyst inside the cavity 583.

The material capable of mixing with the well fluid, such as catalyst 681, may include a salt compound, with a combination of anions and cations. Anions may include for example Chloride [Cl−], Sulfate [SO4−], Carbonate [CO3−], Bicarbonate [HCO3−]. Cations may include for example Sodium [Na+], Calcium [Ca+], Potassium [K+], Magnesium [Mg+].

The material capable of mixing with the well fluid, such as catalyst 681, may include a base or an acid, which can modify the pH of the well fluid entering the cavity 583. Catalyst 681 may also modify the temperature of the well fluid entering the cavity 583, if the reaction between the catalyst 681 and the well fluid is exothermic or endothermic.

The size, shape, density, or other property of the particles of the material capable of mixing with the well fluid may also affect its rate of reaction with the well fluid within the cavity 583. The choice of particles may be based on the desire to have a particular time period during which the properties of the well fluid are modified within the cavity 583, preferably from 1 minute to 48 hours. Therefore, the dissolution rate of the material of the dissolvable untethered object may be modified over this time period. The particles may also include an inert outside dissolvable shell which would delay the reaction with the well fluid, and therefore act as a time delay for the action of the catalyst 681 with the well fluid towards the dissolution of the dissolvable untethered object 680.

In FIG. 16A, a level 682 of catalyst 681 is shown, representing a filling level of catalyst 681 within the cavity 583.

Figure 16B:
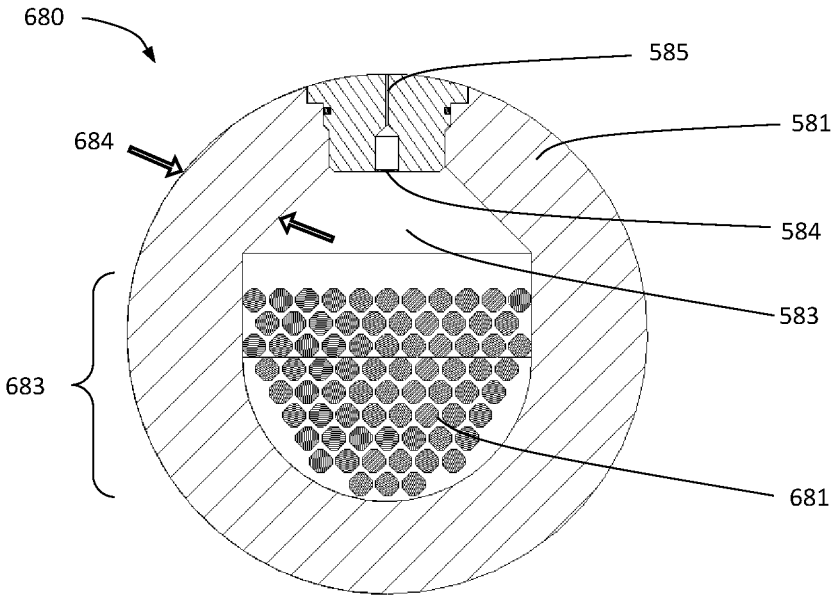
FIG. 16B is a cross-sectional view of FIG. 16A with an increased quantity of catalyst or inhibitor placed inside the cavity of an untethered object.

FIG. 16B represents a similar embodiment of a dissolvable untethered object 680 with another level 683 of catalyst 681 present inside the cavity 583. As represented, the level 683 of FIG. 16B is higher than the level 682 of FIG. 16A. FIG. 16B depicts a thickness 684 of the material of the main section 581. This thickness 684 could represent an average thickness for the dissolvable untethered object 680. The thickness 684 would measure the wall thickness of the dissolvable untethered object 680 between the exterior and the cavity 583. A thicker average thickness 684 would preferably lengthen the dissolution time of the dissolvable untethered object 690 compared to a thinner thickness 684.

The dissolution rate as well as the dissolution duration of the dissolvable untethered object 680 could depend on a combination of design factor like:

average thickness 684 of the dissolvable untethered object 680; and pre-operating factors, before placing the dissolvable untethered object 680, inside well fluid, like:

type of material capable of mixing with the well fluid, such as catalyst 681, such as chemical compound, particle sizes, encapsulation; and quantity of material capable of mixing with the well fluid, such as catalyst 681, represented as filling level 683.

The selection of design factors and pre-operating factors may depend on wellsite conditions. For example, depending on the well fluid properties, the well temperature, the well pressure, the wished operating time of the dissolvable untethered object, a different design selection may be done, as well as the filling of specific type and quantity of material capable of mixing with the well fluid, such as catalyst 681. In addition, the well fluid entry mechanism through the fluid entry point, represented here with a capillarity orifice 585 and a thin section 584, would also adjust the timeframe of the dissolution of the dissolvable untethered object 680.

Figure 17:
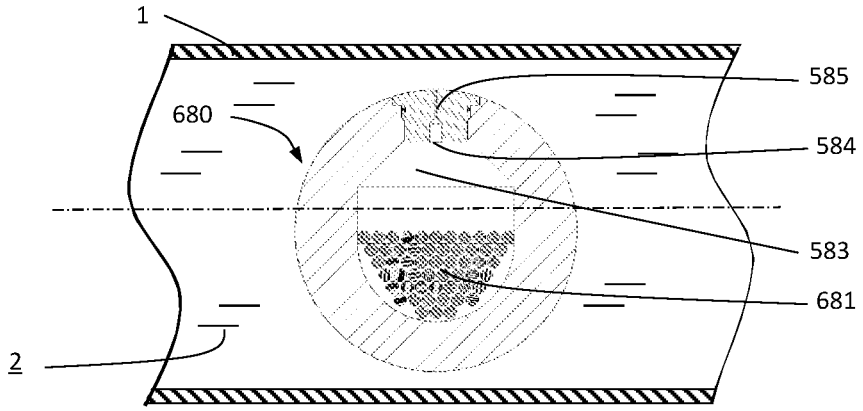
FIG. 17 is a cross-sectional view of a dissolvable untethered object with catalyst or inhibitor inside a cavity, placed inside the well fluid of a tubing string.

FIG. 17 represents a cross-sectional view of a dissolvable untethered object 680 placed inside the well fluid 2 of a tubing string 1. Note that a tubing string 1 is not necessary for the function of this dissolvable untethered object 680 and an open-hole wellbore may be suited as well. FIG. 17 represents the dissolvable object 680 containing a catalyst 681 within the cavity 583. The well fluid 2 may not have entered yet inside the cavity 583 through the capillarity orifice 585, as long as the fluid entry point, represented as thin section 584 is still closed. The catalyst 681 may have no influence on the dissolution rate of the dissolvable untethered object 583, as long as the cavity 583 is kept with the air or gas which was present at surface. The dissolution of the untethered object 680 may still happen on the outside surfaces in contact with the well fluid 2.

Figure 18:
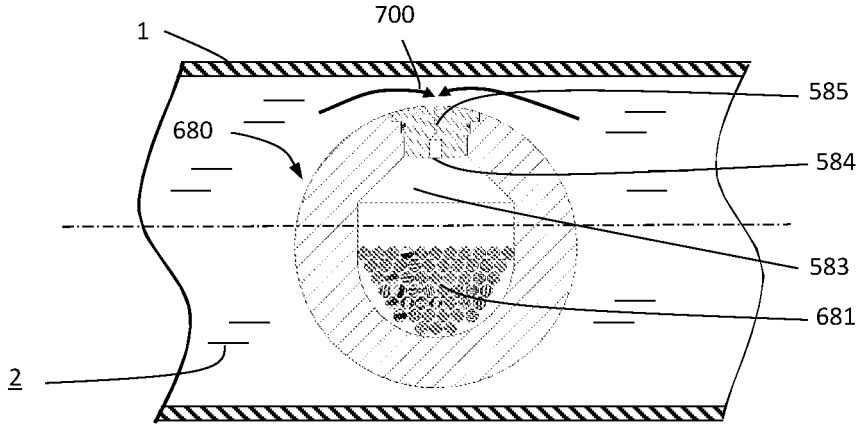
FIG. 18 is a cross-sectional view of a dissolvable untethered object with catalyst or inhibitor inside a cavity, with well fluid entering inside the cavity of the dissolvable untethered object through a pressure entry point.

FIG. 18 represents a cross-sectional view of a dissolvable untethered object 680 placed inside the well fluid 2 of a tubing string 1, sequential of FIG. 17. As the conditions for the well fluid to enter the capillarity orifice 585 are met, such as the well fluid pressure exceed the rupture pressure of the thin section 584, a fluid entry 700 may be possible through the capillarity orifice 585 inside the cavity 583. Other fluid entry mechanisms, such as a timer described in FIG. 14 is also possible, and compatible with this embodiment.

Figure 19:
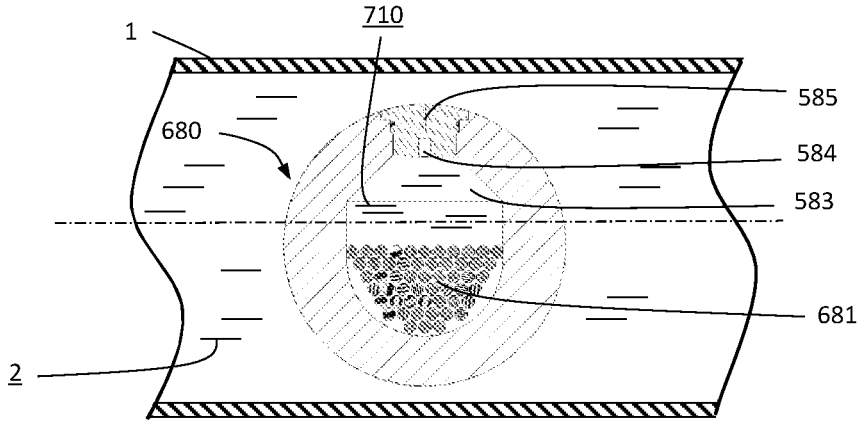
FIG. 19 is a cross-sectional view of a dissolvable untethered object with catalyst or inhibitor inside a cavity, with well fluid reacting with the catalyst or inhibitor inside the cavity of the dissolvable untethered object, and modifying the dissolving rate of the untethered object.

FIG. 19 represents a cross-sectional view of a dissolvable untethered object 680 placed inside the well fluid 2 of a tubing string 1, sequential of FIG. 18. In FIG. 19, penetrated well fluid 710 has replaced the air or gas previously present inside the cavity 583. The air or gas may then be dissipated inside the rest of the well fluid 2 present inside the tubing string 1. As described in FIGS. 6A and 6B, the catalyst 681 may react with the penetrated well fluid 710 present inside the cavity 583. The reaction between penetrated well fluid 710 and catalyst 681, as well as the new chemical solution created by the reaction, may modify the dissolving rate of the material in contact with this new chemical solution, which is in particular the inner surface of the cavity 583. Possibly, the particle size of the catalyst 681 may be bigger than the diameter of the capillarity orifice 585 to prevent catalyst 681 passage through the capillarity orifice 585, at least at the start of the reaction with the penetrated well fluid 710.

Figure 20:
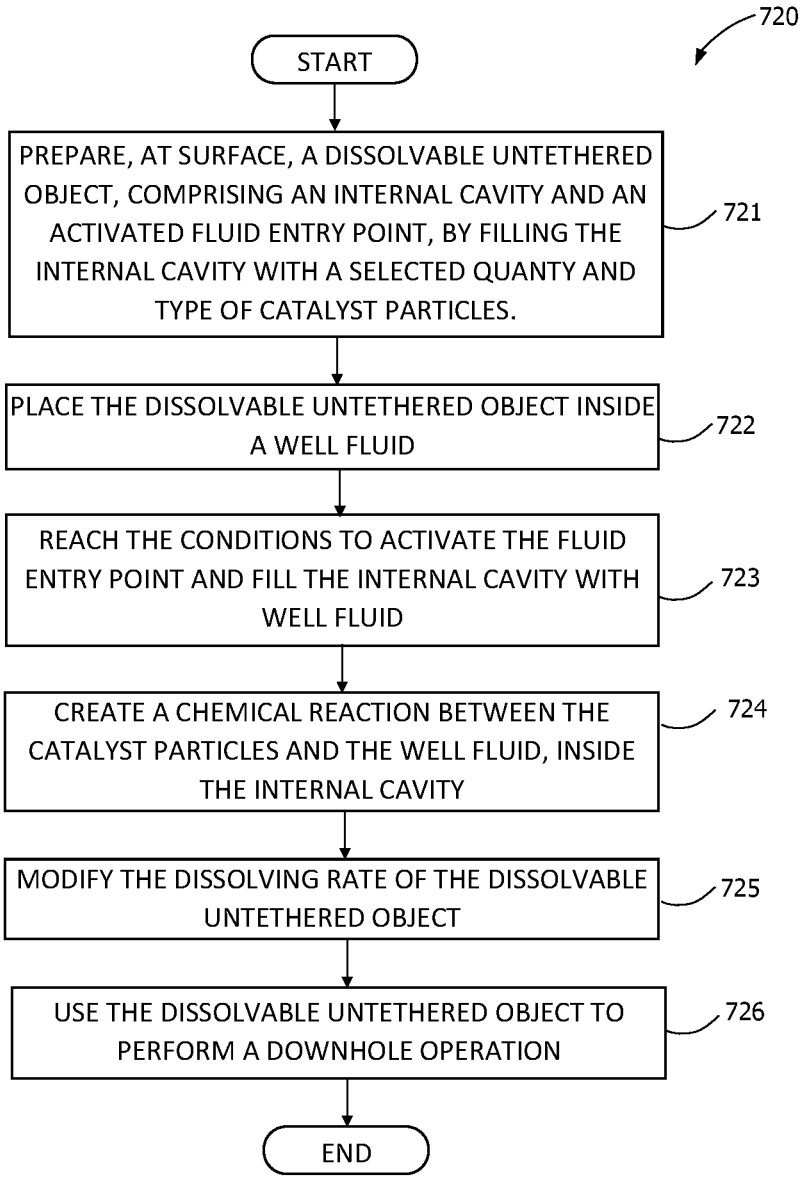
FIG. 20 is a flow diagram representing a technique sequence of preparing a dissolvable untethered object with a catalyst or inhibitor, placing the dissolvable untethered object inside well fluid, and having well fluid entering inside the cavity and reacting with the catalyst or inhibitor inside the cavity of the dissolvable untethered object, and modifying the dissolving rate of the untethered object.

FIG. 20 represents a technique sequence 720, which includes steps depicted in FIGS. 17 to 19. Step 721 corresponds to the preparation, at surface, of a dissolvable untethered object 680, comprising an internal cavity 583 and an activated fluid entry point 584, by filling the internal cavity 583 with a selected quantity and type of a material capable of mixing with the well fluid, such as catalyst particles 681. Step 722 corresponds to the placement of the dissolvable untethered object 680 inside a well fluid 2. In step 723, the conditions to activate the fluid entry point 584 are reached and well fluid fills the internal cavity 583 through the fluid entry point 584. In step 724, a chemical reaction between the catalyst particles 681 and the penetrated well fluid 710 inside the internal cavity is created. In step 725, the dissolving rate of the dissolvable untethered object 680 is accelerated by the contact of the chemically reacting well fluid 710 and catalyst particles 681, along the surface of the cavity 583. In other cases, the dissolving rate of the dissolvable untethered object 680 is decelerated by the contact of the chemically reacting well fluid 710 and the surface of the cavity 583. Finally step 726 corresponds to the further usage of the dissolving untethered object to perform a downhole operation.

Figure 21A:
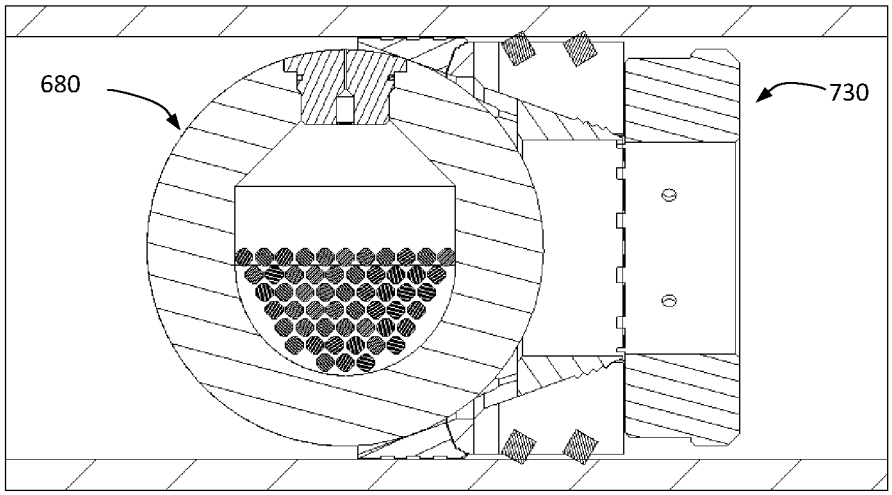
FIG. 21A is a cross-sectional view of set plug assembly inside a tubing string and receiving a dissolvable untethered object with a cavity containing a catalyst or an inhibitor, inside well fluid.
Figure 21B:
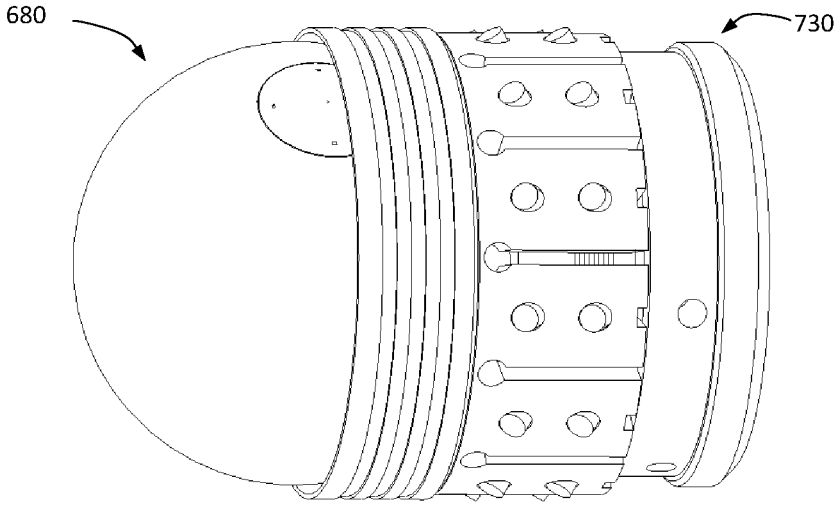
FIG. 21B is an isometric view of FIG. 21A without showing the tubing string.

FIGS. 21A and 21B represent a cross-section view and isometric view of combining the dissolvable untethered object 680 with a plug assembly 730. In the shown example, the plug assembly 730 is similar to the embodiments described in FIGS. 1 to 5. However, the plug assembly 730 may alternatively be implemented with other plug assemblies, including but not limited to, the plug assemblies described herein.

The disclosure describes a method comprising the step of providing a programmable starter configured to be conveyed within a dissolvable untethered object. The dissolvable untethered object may comprise a gas-filled internal cavity and an electronic actuated fluid entry point. The method comprises the step of presetting the programmable starter with desired actuation conditions. The method comprises the step of placing the dissolvable untethered object inside well fluid. The method comprises the step of causing the programmable starter to open the electronic actuated fluid entry point upon reaching the desired actuation conditions. The method comprises the step of filling the gas-filled internal cavity with well fluid flowing through the electronic actuated fluid entry point. The method comprises the step of dissolving the dissolvable untethered object at a modified dissolving rate after contact of the well fluid with a surface of the internal cavity. The modified dissolving rate may be a faster rate.

In some embodiments, the method may further comprise the step of using the dissolvable untethered object to perform a downhole operation. Presetting the programmable starter with the desired actuation conditions may include presetting a time, a pressure, a temperature, a well fluid property like pH or salinity, or a combination thereof. Opening the electronic actuated fluid entry point may comprise disintegrating a section of material by passing an electric current through the section.

The disclosure also describes a dissolvable untethered object apparatus for use inside a well fluid. The dissolvable untethered object apparatus comprises a gas-filled internal cavity, an electronic actuated fluid entry point, and a programmable starter. The programmable starter may be preset at surface with desired actuation conditions. The fluid entry point may allow well fluid passage when electrically activated by the programmable starter. The programmable starter may be programmed to open the electronic fluid entry point upon detecting that the desired actuation conditions have been reached. Accordingly, the gas-filled internal cavity may be filled with the well fluid flowing through the fluid entry point after the programmable starter opens the electronic fluid entry point, and a dissolving rate of the dissolvable untethered object may be modified after contact of the well fluid with a surface of the internal cavity. The modified dissolving rate may be a faster rate.

In some embodiments, presetting the programmable starter with the desired actuation conditions may include presetting a time, a pressure, a temperature, a well fluid property like pH or salinity, or a combination thereof. The electronic actuated fluid entry point may be open by disintegrating a section of material by passing an electric current through the section.

The disclosure also describes a method comprising the step of selecting a quantity and type of particles. The method comprises the step of preparing, at surface, a dissolvable untethered object, comprising an internal cavity and a preset condition activated fluid entry point, by placing the selected quantity and type of particles inside the internal cavity. The method comprises the step of placing the dissolvable untethered object inside a well fluid. The method comprises the step of filling the internal cavity with well fluid flowing through the activated fluid entry point upon reaching the preset condition to activate the fluid entry point. The method comprises the step of chemically reacting the particles and the well fluid upon the well fluid flowing inside the internal cavity. The method comprises the step of dissolving the dissolvable untethered object at a modified dissolving rate after contact of the product of the chemical reaction of the well fluid and the particles with a surface of the internal cavity. In the cases when the particles are catalyst particles, the modified dissolving rate may be a faster rate.

In some embodiments, the method may comprise the step of using the dissolvable untethered object to perform a downhole operation. Selecting the quantity and type of particles may be based on well properties such as temperature, pressure, well fluid chemical composition, duration of downhole operation. Reaching the preset condition to activate the fluid entry point may include exceeding a well fluid pressure or matching a preset programmable condition.

The disclosure also describes a dissolvable untethered object for use inside a well fluid. The dissolvable untethered object comprises an internal cavity in which a selected quantity and type of particles has been placed previously at surface. The dissolvable untethered object comprises a fluid entry point activated by preset conditions. The internal cavity is filled with the well fluid flowing through the fluid entry point after the preset conditions are met inside the well fluid. The particles are reacting with the well fluid chemically. The dissolving rate of the dissolvable untethered object is modified by the contact of the product of the chemical reaction inside the internal cavity with a surface of the cavity. In the cases when the particles are catalyst particles, the modified dissolving rate may be a faster rate.

In some embodiments, the particles may react neither with gas contained in the internal cavity nor with the material of the dissolvable untethered object, until the chemical reaction with the well fluid occurs. The particles may have a solid form, such as power, pellet, block or an encapsulated liquid form with a shell dissolving inside well fluid. The fluid entry point may be activated by well fluid conditions, such as pressure, or by a programmable starter included inside the dissolvable untethered object. The particles may be sized to remain inside the internal cavity at the beginning of the chemical reaction with the well fluid, such as for a duration between one minute and one week. The particles may be solid pellets.

What is claimed is:

1. A method comprising:

placing a dissolvable untethered object, comprising an internal cavity and a fluid entry point inside a well fluid, wherein the fluid entry point includes one or more capillarity holes, having each an average hole diameter, wherein the fluid entry point is closed and is selectively openable, and wherein the internal cavity contains a gas;

causing the fluid entry point to open;

filling the internal cavity of the dissolvable untethered object with well fluid flowing through the one or more capillarity holes and through the fluid entry point, wherein each of the average hole diameter of the one or more capillarity holes is not modified by the filling of the internal cavity of the dissolvable untethered object; and modifying a dissolving rate of the dissolvable untethered object.

2. The method of claim 1, wherein modifying the dissolving rate of the dissolvable untethered object comprises dissolving the dissolvable untethered object at a faster dissolving rate after contact of the well fluid inside the internal cavity with the dissolvable untethered object.

3. The method of claim 2, wherein causing the fluid entry point to open comprises:

increasing pressure of the well fluid surrounding the dissolvable untethered object; and opening the fluid entry point upon the fluid pressure exceeding a fluid pressure rating of the fluid entry point.

4. The method of claim 3, wherein opening the fluid entry point includes applying the well fluid pressure on a pressure rated thin section and rupturing the pressure rated thin section using the well fluid pressure.

5. The method of claim 3, wherein opening the fluid entry point includes applying the well fluid pressure on a pressure relief valve and displacing a plunger of the pressure relief valve using the well fluid pressure.

6. The method of claim 3, wherein increasing the well fluid pressure occurs through hydrostatic pressure increasing due to depth of the untethered dissolving object within a wellbore, or through pump usage.

7. The method of claim 2, wherein the dissolvable untethered object includes a material dissolvable by well fluid.

8. The method of claim 7, wherein the gas is air or inert gas.

9. The method of claim 2, further comprising:

preparing, at surface, the dissolvable untethered object, by placing a selected quantity and type of catalyst particles inside the internal cavity; and reacting the catalyst particles and the well fluid chemically upon the internal cavity of the dissolvable untethered object filling with well fluid, wherein the dissolvable untethered object includes a material dissolvable by the product of the reaction of the catalyst particles and the well fluid.

10. The method of claim 1, further comprising using the dissolvable untethered object to perform a downhole operation.

11. An apparatus, for use inside a well fluid, comprising:

a dissolvable untethered object including:

an internal cavity; and a fluid entry point;

wherein the fluid entry point includes one or more capillarity holes, having each an average hole diameter, wherein each of the average hole diameter of the one or more capillarity holes is not modified by the filling of the internal cavity of the dissolvable untethered object, wherein the fluid entry point is closed and selectively openable so that the internal cavity can be filled with the well fluid flowing through the fluid entry point and a dissolving rate of the dissolvable untethered object is modified after contact of the well fluid inside the internal cavity with the dissolvable untethered object, and wherein the internal cavity contains a gas.

12. The apparatus of claim 11, wherein the dissolvable untethered object includes dissolvable material reacting with well fluid.

13. The apparatus of claim 12, wherein the gas does not dissolve the dissolvable untethered object.

14. The apparatus of claim 12, wherein the well fluid includes water, brine, acid solution, gel solution, produced fluid such as produced water and hydrocarbons.

15. The apparatus of claim 11, wherein the fluid entry point is configured for opening upon the fluid pressure surrounding the dissolvable untethered object exceeding a fluid pressure rating of the fluid entry point.

16. The apparatus of claim 15, whereby the fluid entry point activated by fluid pressure includes a thin section, such as rupture disc or a pressure relief valve.

17. The apparatus of claim 15, wherein the fluid pressure rating is within a pressure interval ranging from 1 psi to 30,000 psi [0.007 MPa to 200 MPa].

18. The apparatus of claim 11, wherein the dissolvable untethered object is a sphere, a dart, a pill, or a polyhedron.

19. The apparatus of claim 11, further comprising a selected quantity and type of catalyst particles, wherein the catalyst particles are capable of reacting with the well fluid upon the internal cavity being filled with the well fluid flowing through the fluid entry point; and wherein the dissolvable untethered object includes a material dissolvable by the product of the reaction of the catalyst particles and the well fluid.

20. The apparatus of claim 11, wherein the average hole diameter of the one or more capillarity holes of the fluid entry point is within 0.1 mm to 5 mm [0.004 in to 0.2 in].

* * * * *